US005135373A

United States Patent [19]

Cozens

[11] Patent Number: 5,135,373

[45] Date of Patent: Aug. 4, 1992

[54] SPUR GEAR WITH EPI-CYCLOIDAL AND HYPO-CYCLOIDAL TOOTH SHAPES

[75] Inventor: Eric Cozens, Oakville, Canada

[73] Assignee: Stackpole Limited, Mississauga, Canada

[21] Appl. No.: 607,703

[22] Filed: Nov. 1, 1990

[51] Int. Cl.[5] ..... F04C 2/14

[52] U.S. Cl. ..... 418/190; 418/206; 74/462; 475/180

[58] Field of Search ..... 418/150, 190, 206; 74/462; 475/180

[56] References Cited

U.S. PATENT DOCUMENTS

| | | | |
|---|---|---|---|
| 2,778,316 | 1/1959 | Haight et al. | 418/206 |
| 3,469,531 | 9/1969 | Wood | 418/206 |
| 3,709,055 | 1/1973 | Grove | 418/206 |
| 3,946,621 | 3/1976 | Rouverol | 74/472 |
| 4,155,686 | 5/1979 | Eisenmann et al. | 418/170 |
| 4,673,342 | 6/1987 | Saegusa | 74/462 |
| 4,922,781 | 5/1990 | Peiji | 418/171 |

*Primary Examiner*—Richard A. Bertsch
*Assistant Examiner*—David L. Cavanaugh
*Attorney, Agent, or Firm*—Eugene J. A. Gierczak

[57] ABSTRACT

A spur pump gear system comprising; a housing have a sealed chamber communicating with an intake port and a discharge port; a shaft journalled for rotation within said chamber; a drive spur gear mounted concentrically on said shaft about a first axis within said chamber, said drive spur gear presenting epi and hypo cycloid tooth profiles; a driven spur gear disposed internally within said chamber for rotation about a second axis, said driven spur gear presenting epi and hypo cycloid tooth profiles; said epi hypo cycloid tooth profile of said drive spur gear engagedly driving said hypo cycloid tooth profile of said driven spur gear.

9 Claims, 4 Drawing Sheets

SPUR GEAR WITH EPI-CYCLOIDAL AND HYPO-CYCLOIDAL TOOTH SHAPES

FIELD OF INVENTION

This invention relates to spur gears presenting epi and hypo cycloid tooth profiles; and in particular relates to a spur gear pump system having a drive spur gear and a driven spur gear presenting epi and hypo cycloidal tooth profiles.

BACKGROUND OF THE INVENTION

Spur pump gear systems generally consist of two or more spur gears operating in mesh. The gear set operates in a sealed housing with the drive gear turning the driven gear in mesh at drive top dead bend. The bottom dead bend is generally sealed with the tips of the gear teeth as they turn in the housing pocket.

Conventional spur gear pumps utilize involute gear forms which are well suited to most applications.

For example U.S. Pat. No. 246,724 illustrates a pair of spur gears.

Furthermore U.S. Pat. No. 3,130,682 teaches a gear pump comprising a housing having and inlet and an outlet port and a pair of meshing gears rotatably received in the housing, the gears each having involute gear teeth forming a deddendum pocket therebetween in the areas of meshing engagement.

Yet another arrangement is shown in U.S. Pat. No. 2,975,718 which illustrates two meshing spur gears which are journalled on stub shafts.

Finally, U.S. Pat. No. 294,026 teaches pistons made with a series of thin curved wings or blades extending outwardly in a radial manner from the central hob or core.

In some cases where the size of the gear housing is restricted, and a large flow of oil is required from the pump, gears with as few as seven teeth are used to produce the maximum flow volume from the pump. Due to the mathematical generation of involute curves, the gear teeth in such situations will tend to push the limitations of the involute form causing the gear set to operate with contact ratios only slightly higher than 1.0 and producing high contact stresses in the root area of the gear.

Accordingly, it is an object of this invention to produce an improved spur gear set and in particular to provide an improved spur gear pump system.

It is an aspect of this invention to provide a spur gear set comprising; a drive spur gear journalled for rotation about a first axis, said drive gear presenting epi and hypo cycloid tooth profiles; a driven spur gear journalled for rotation about a second axis, said driven spur gear presenting epi and hypo cycloid tooth profiles; said epi cycloid tooth profile of said driven spur gear engagedly driving said hypo cycloid tooth profile of said driven spur gear.

It is another aspect of this invention to provide a spur pump gear system comprising; a housing having a sealed chamber communicating with an intake port and a discharge port; a shaft journalled for rotation within said chamber; a drive spur gear mounted concentrically on said shaft for rotation about a first axis within said chamber, said drive spur gear presenting epi and hypo cycloid tooth profiles; a driven spur gear disposed internally within said chamber for rotation about a second axis, said driven spur gear presenting epi and hypo cycloid tooth profiles; said epi cycloid tooth profile of said drive spur gear engagedly driving said hypo cycloid tooth profile of said driven spur gear.

It is another aspect of this invention to provide a method of producing cycloid tooth profiles for a spur gear set comprising the steps of; determining the outside diameter of a first spur gear; generating a pitch circle of said first spur gear; producing an epi cycloid by rolling said epi cycloid in a clockwise direction about said pitch circle of said first spur gear starting at the vertical axis until said epi cycloid intersects said outside diameter of said first spur gear; producing a hypo cycloid by rolling said hypo cycloid in a counterclockwise direction around said pitch circle of said first spur gear starting at the vertical axis until said generated curve intersects the tooth flank of said first spur gear; connecting said epi and hypo cycloid to the profiles of said first spur gear; completing the tooth profile of said first spur gear by rotating and mirroring the resulting gear form about said pitch circle of said first spur gear at increments equal to 360 divided by the number of teeth of said first spur gear; repeating the above steps for said second spur gear.

DESCRIPTION OF DRAWINGS

These and other objects and features of the invention shall now be described in relation to the following drawings.

DESCRIPTION OF THE INVENTION

Like parts have been given like numbers throughout the figures.

Figure 1:
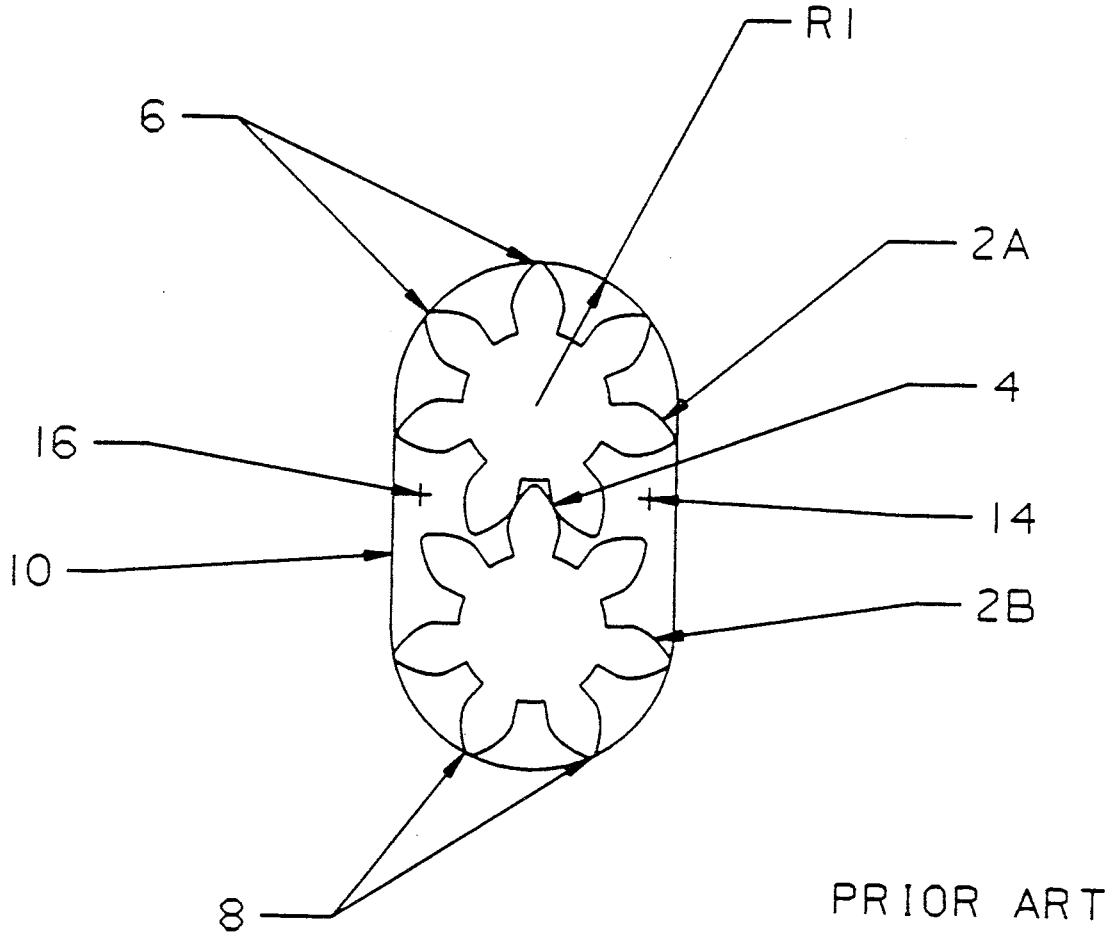
FIG. 1 illustrates a prior art involute spur gear pump arrangement.

FIG. 1 illustrates a top plan view of the prior art involute spur gear set 2*a* and 2*b*. Involute gears may be used as oil pump gears in sets which sit side-by-side, one gear 2*a* driving the other gear 2*b*. These involute gears 2*a* and 2*b* are generally spur gears with a very low number of teeth, with low contact ratios, and high pressure angles. The involute gears 2*a* and 2*b* seal off the dead band area across the contact point 4 on the involute drive surface and at the tips of the gear teeth 6 and 8 and the housing wall 10 which defines the chamber pocket 12.

As with other generated rotor gears suction is produced by the separation of the gears on the intake side 14 and pressure is created by the collapsing of the gears on the output side 16.

The cycloidal spur gear to be described herein operates in a similar manner as involute spur gears as referred to in FIG. 1 but offers the advantages of increased work tooth depth, increased displacement with equal pocket size, and increased contact ratios with more consistent pressure angles and more consistent contact stresses at the gear base circle diameter than is generally available with involute spur gears.

The spur gears 2*a* and 2*b* illustrated in FIG. 1 have the same radius $R_1$.

Figure 2:
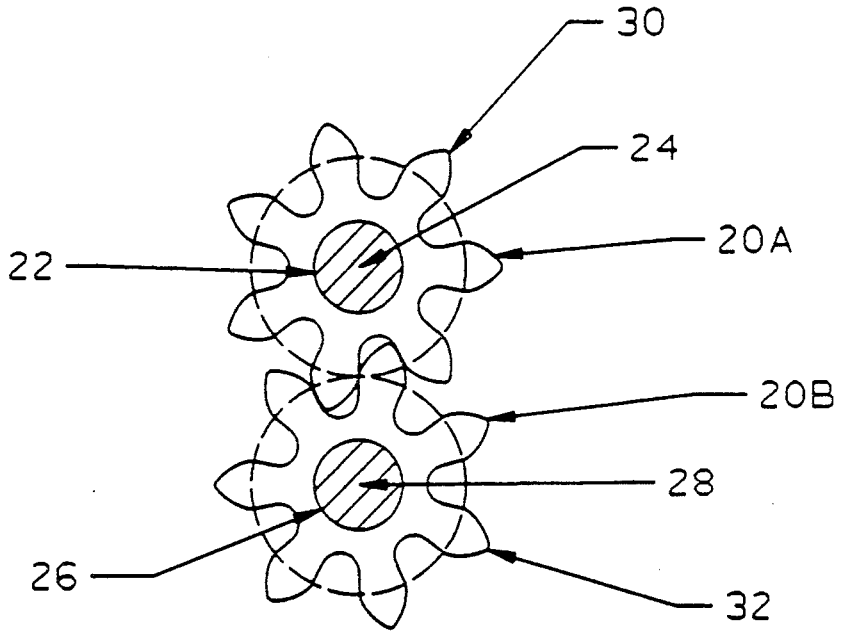
FIG. 2 illustrates a top plan view of the cycloidal spur gear set.

FIG. 2 illustrates a cycloidal spur gear set 20*a* and 20*b*. Spur gear 20*a* comprises of a first spur gear or drive spur gear 20*a* which is journalled for rotation about a shaft 22 having a first axis 24.

First spur gear or drive spur gear 20*a* is adapted to engageably contact and rotate second spur gear or driven spur gear 20*b*. Driven spur gear 20*b* is journalled about a second shaft 26 which is adapted for rotation about a second axis 28.

The drive spur gear 24 and driven spur gear 28 are disposed interiorally of chamber pocket 12 which is best illustrated in FIG. 1. Shafts 22 and 26 are adapted to be disposed interiorally of chamber pocket 12 which is defined by housing wall 10 in a sealed manner.

Furthermore the tips 30 of drive spur gear 20*b* and the tips 32 of driven spur gear 20*b* are adapted to contact or seal along the bottom dead bend in a similar manner as that described with the involute gears shown in FIG. 1.

Figure 3:
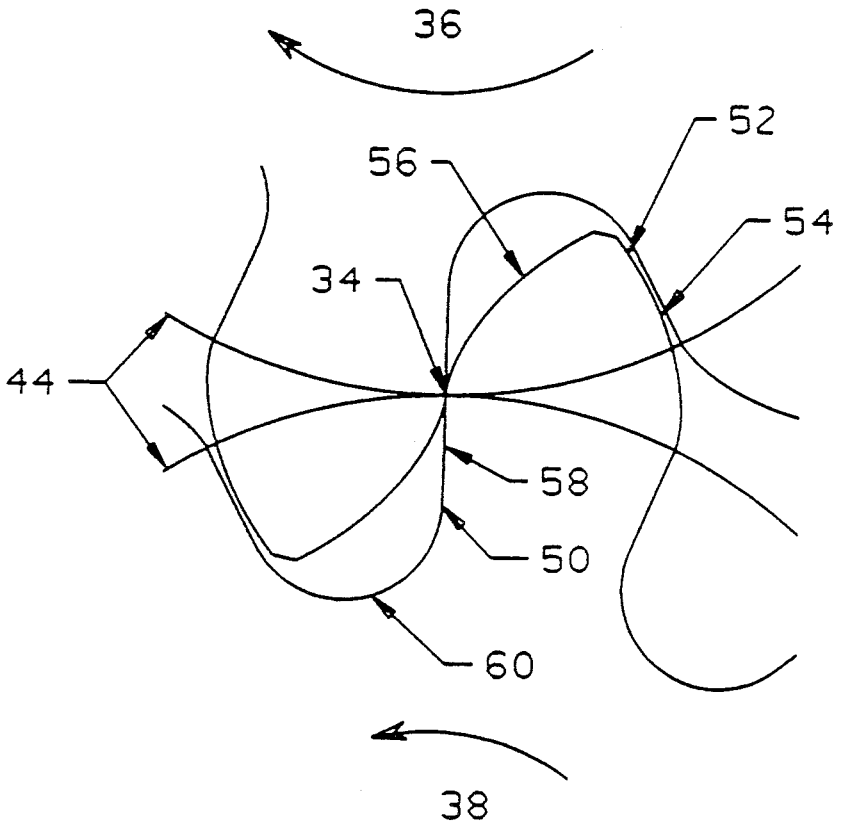
FIG. 3 is a partial top plan view of the tooth engagement of the invention.

Moreover the drive spur gear 20*a* is adapted to contact or mesh with driven spur gear 20*b* at the drive top dead band 34 as best illustrated in FIG. 3.

Arrows 36 and 38 illustrate the direction of rotation of drive spur gear 20*a* and driven spur gear 20*b* within the 2 of the pump arrangement illustrated in FIG. 1.

Figure 4:
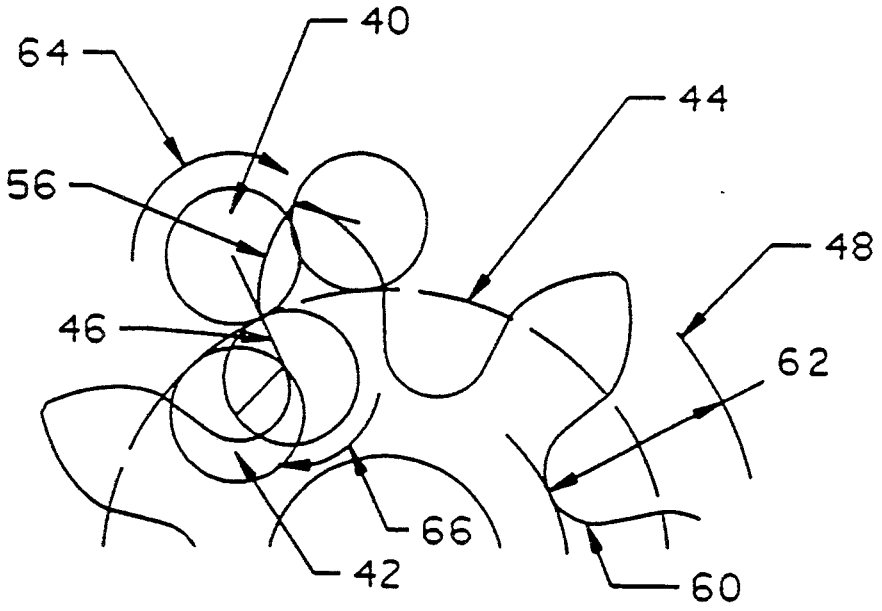
FIG. 4 is a partial top plan view of the construction of the cycloidal spur gear.

The generation of the cycloidal tooth profile of the spur gears 20*a* and 20*b* shall now be illustrated in relation to FIG. 4.

The cycloid spur gear 20*a* and 20*b* is generated using a pair of epi and hypo cycloid sets 40 and 42, respectively, rolling around a single generating or pitch circle 44.

In particular the cycloidal spur gear form is generated as follows:

(a) The epi cycloid 40 is rolled in a clockwise direction about the generating or pitch circle 44 starting at the vertical axis 46 until the epi cycloid 40 intersects the gear outside diameter 48.

(b) The hypo cycloid 42 is rolled in a counterclockwise direction around the generating or pitch circle 44 starting at the vertical axis 46 until the generated curve intersects the tooth flank or root radius 50 as best illustrated in FIG. 3.

(c) The generated tooth form is rotated and mirrored using the same construction techniques as standard involute curves.

FIG. 3 also illustrates the option of providing a tip relief 52 which may also be described as the deviated tooth form. The tip relief 52 comprises a clearance space between the noncontactive side of the gear teeth which will allow oil flow back and flow reversal to occur between gears and reduce cavitation at high speeds. Moreover the backlash 54 is illustrated in FIG. 3.

The upper tooth profile is shown as 56 in FIG. 3 and the lower tooth profile is illustrated as 58.

A full radius at the root 60 is shown in FIG. 3.

The working depth of the spur gear sets is illustrated by numeral 62 shown in FIG. 4 while the direction of rotation of epi cycloid 40 is shown as 64 with the direction of rotation of hypo cycloid 42 shown as 66 in FIG. 4.

The cycloidal spur gears 20*a* and 20*b* utilizing the epi and hypo cycloid curves as described herein for the tooth form generation allow the gear set to operate with fewer teeth and an increase swept area than is available with the involute spur gear forms utilized to date. The swept area is maximized by utilizing the two cycloids on each tooth with the epi cycloid of the drive gear running on the hypo cycloid of the driven gear. This allows the pump to displace more oil from-an equivalent sized gear set or the same amount of oil from a smaller more efficient gear set. Since the cycloidal spur gear utilize the cycloidal gear form, the contact ratios can remain relatively high and contact stresses in the root area are generally minimized.

It is felt that by utilizing the invention as described herein the cycloidal spur gear sets will offer the following advantages over conventional crescent gear sets: namely;

(a) maximize the theoretical pump displacement with respect to pump size through the use of a minimum number of gear teeth and the maximized swept volume capability;

(b) minimize compressive gear stress through nearly constant normal roll of the drive gear with the driven gear.

Although the preferred embodiment as well as the operation and use have been specifically described in relation to the drawings, it should be understood that variations in the preferred embodiment could easily be achieved by a man skilled in the art without departing from the spirit of the invention. Accordingly the invention should not be understood to be limited to the exact form revealed by the drawings.

The embodiments of the invention in which an exclusive property or privilege is claimed are defined as follows:

1. In a spur gear set comprising;

(a) drive spur gear means journalled for rotation about a first axis and having a drive gear pitch circle, said first spur gear means having epi and hypo cycloid tooth profiles generated about said pitch circle of said drive spur gear;

(b) driven spur gear means journalled for rotation about a second axis and having a driven gear pitch circle, said driven spur gear means having epi and hypo cycloid tooth profiles generated about said pitch circle of said driven gear;

(c) said epi cycloid tooth profile of said drive spur gear means engageably driving said hypo cycloid tooth profile of said drive spur gear means.

2. In a spur gear set as claimed in claim 1 wherein said tooth profiles of said drive spur gear and said driven spur gear have a root radius joining adjacent teeth.

3. In a spur gear set as claimed in claim 2 wherein said pitch circles of said drive spur gear means and said driven spur gear means are equal and said diameters of said epi and hypo cycloids of said driven and drive spur gear means are equal.

4. In a spur pump gear system comprising:

(a) housing means having a sealed camber communicating with an input port and a discharge port;

(b) shaft means journalled for rotation within said chamber;

(c) drive spur gear means mounted concentrically on said shaft means about a first axis within said chamber means and having a drive gear pitch circle, said drive spur gear means having epi and hypo cycloid tooth profiles generated about said pitch circle of said drive spur gear;

(d) driven spur gear means disposed interiorally within said chamber means for rotation about a second axis and having a driven gear pitch circle, said driven spur gear means having epi and hypo cycloid tooth profiles generated abut said pitch circle of said driven gear;

(e) said epi cycloid tooth profile of said drive spur gear means engageably driving said hypo cycloid tooth profile of said driven spur gear means.

5. In a spur pump gear system as claimed in claim 4 wherein said tooth profile of said drive spur gear means and said driven spur gear means contact a portion of said housing means so as to present a dead band area.

6. In a spur pump gear system as claimed in claim 5 wherein said dead band area is defined by the tips of said drive spur gear means and the tips of said driven spur gear means contacting said housing during rotation thereof.

7. In a spur pump gear system as claimed in claim 6 wherein said drive spur gear means and said driven spur gear means define a top drive dead band in the region of rotational contact of said drive spur gear means and said driven spur gear means.

8. In a spur pump gear system as claimed in claim 7 wherein said tooth profiles of said drive spur gear and said driven spur gear having a root radius joining adjacent teeth.

9. In a method of producing cycloidal tooth profiles in a spur gear set comprising the steps of:

(a) determining the outside diameter of a first spur gear;

(b) generating a pitch circle of said first spur gear;

(c) producing an epi cycloid by rolling said epi cycloid in a clockwise direction about said pitch circle of said first spur gear starting at the vertical axis until the epi cycloid intersects said outside diameter of said first spur gear;

(d) producing a hypo cycloid by rolling said hypo cycloid in a counterclockwise direction around said pitch circle of said first spur gear staring at the vertical axis until said generated curve intersects the tooth flank of said first spur gear;

(e) connecting said epi and hypo tooth profiles of said first spur gear;

(f) completing the gear profile of said first spur gear by rotating and mirroring the resulting gear form about said pitch circle of said first spur gear at increments equal to 360° divided by the number of teeth of said first spur gear;

(g) producing a root radius to joining adjacent tooth profiles;

(h) repeating the above steps for said second spur gear about the pitch circle of sad second spur gear.

* * * * *